United States Patent [19]

Ille

[11] 4,145,958

[45] Mar. 27, 1979

[54] FLUID CONTROL SYSTEM WITH AUTOMATICALLY ACTUATED MOTOR PORT LOCK-OUT VALVES

[75] Inventor: David R. Ille, Wooster, Ohio

[73] Assignee: Borg-Warner Corporation, Chicago, Ill.

[21] Appl. No.: 856,878

[22] Filed: Dec. 2, 1977

[51] Int. Cl.[2] ..... F15B 11/16

[52] U.S. Cl. ..... 91/525; 91/530; 91/433; 60/484

[58] Field of Search ..... 91/412, 414, 433, 462; 60/484; 137/115

[56] References Cited

U.S. PATENT DOCUMENTS

| | | | |
|---|---|---|---|
| 2,214,817 | 9/1940 | Harrington | 60/468 X |
| 2,215,115 | 9/1940 | Buffington | 60/472 |
| 2,750,743 | 6/1956 | Korkowski et al. | 91/433 |
| 3,592,216 | 7/1971 | McMillen | 137/115 |
| 3,631,890 | 1/1972 | McMillen | 137/596.13 |
| 3,693,506 | 9/1972 | McMillen et al. | 91/412 |

*Primary Examiner*—Edgar W. Geoghegan
*Attorney, Agent, or Firm*—Julian Schachner

[57] ABSTRACT

A fluid control system includes a directional control valve assembly adapted for use in either an open center or a closed center configuration. The assembly is capable of incorporating one or more control sections, each with a manual control valve having its own variable pressure compensated flow controlling mechanism. Motor port lock-out valves are associated with each manual control valve, and a pressure responsive logic circuit automatically actuates the lock-out valves to hold them open when their associated manual control valve is in the power or float positions. When any manual control valve is in the float position, any other manual control valve may be operated in the power positions.

25 Claims, 5 Drawing Figures

FLUID CONTROL SYSTEM WITH AUTOMATICALLY ACTUATED MOTOR PORT LOCK-OUT VALVES

BACKGROUND OF THE INVENTION

In recent years there has been significant progress in the development of pressure compensated directional control valve assemblies for fluid control systems. U.S. Pat. No. 3,693,506 discloses a control circuit for a plurality of manual control valves, each controlling a fluid motor. The control circuit includes a logic system for sensing each load-actuating pressure, and for selecting the highest pressure sensed and directing this pressure to actuate means for controlling a source of supply pressure. U.S. Pat. No. 3,592,216 discloses a flow control valve for use with such a control circuit. The flow control valve limits the pressure supplied to the manual control valves and maintains the required fluid flow thereto. U.S. Pat. No. 3,631,890 discloses a flow-extending bypass valve which may be used with the control circuit. The flow-extending bypass valve adjusts automatically to bypass fluid at an increased differential pressure when a fluid motor is actuated, thereby extending the flow capacity of the manual control valve associated with the fluid motor.

There remains a need in the art for a directional control valve assembly having a manual control valve movable to a float position, and having motor port lock-out valves actuated automatically when the manual control valve is moved to the float position. Such automatic acutation should take place at a pressure well below load-actuating pressure. When the directional control valve assembly incorporates a plurality of manual control valves, or when a plurality of assemblies are incorporated in the fluid control system, the motor port lock-out valves should remain open while their associated manual control valve is in the float position, and still allow operation of any of the remaining manual control valves in the power positions.

SUMMARY OF THE INVENTION

This invention is directed in brief to a fluid control system capable of meeting the need noted above. The system includes a fluid supply section, an inlet section having a bypass valve, and a directional control valve assembly having at least one control section, with each control section including a manual control valve. Each manual control valve is adapted for connection to a fluid motor through a pair of pilot-operated motor port lock-out valves.

Each assembly also includes a logic circuit for controlling fluid pressure at the bypass valve so as to cause actuation of the lock-out valves when the manual control valve is in the power or float positions. Acutation of the lock-out valves is at a pressure well below load-actuating pressure. The logic circuit maintains any pair of lock-out valves open when their associated manual control valve is in the float position, while at the same time allowing power operation of any remaining manual control valves in the assembly.

The invention contemplates that the fluid control system may include a plurality of directional control valve assemblies. In this arrangement there are a fluid supply section, an inlet section having a bypass valve, and a plurality of directional control valve assemblies each having one or more control sections, with each control section including a flow control valve and a manual control valve adapted for connection to a fluid motor through a pair of pilot-operated motor port lock-out valves. The logic circuit maintains any pair of lock-out valves open when their associated manual control valve is in the power or float positions, and when in float allows power operation of any remaining manual control valve in any of the assemblies.

BRIEF DESCRIPTION OF THE DRAWINGS

The objects and advantages of this invention will become apparent to those skilled in the art upon careful consideration of the specification herein, including the drawings, wherein.

Figure 1:
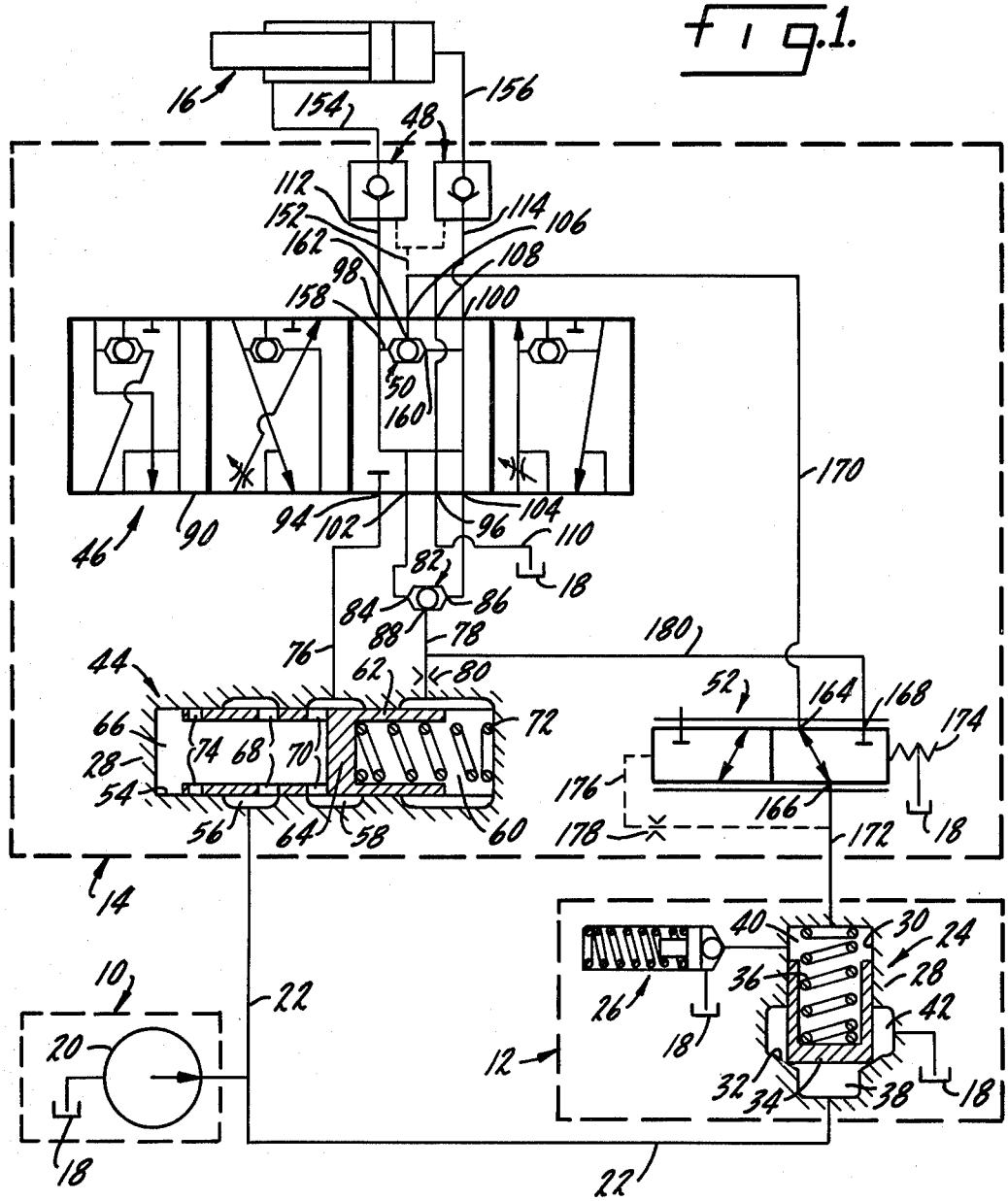
FIG. 1, is a schematic diagram showing the fluid control system including a directional control valve assembly having a single control section.

While this invention is susceptible of embodiment in many different forms, there is shown in the drawings and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Figure 2:
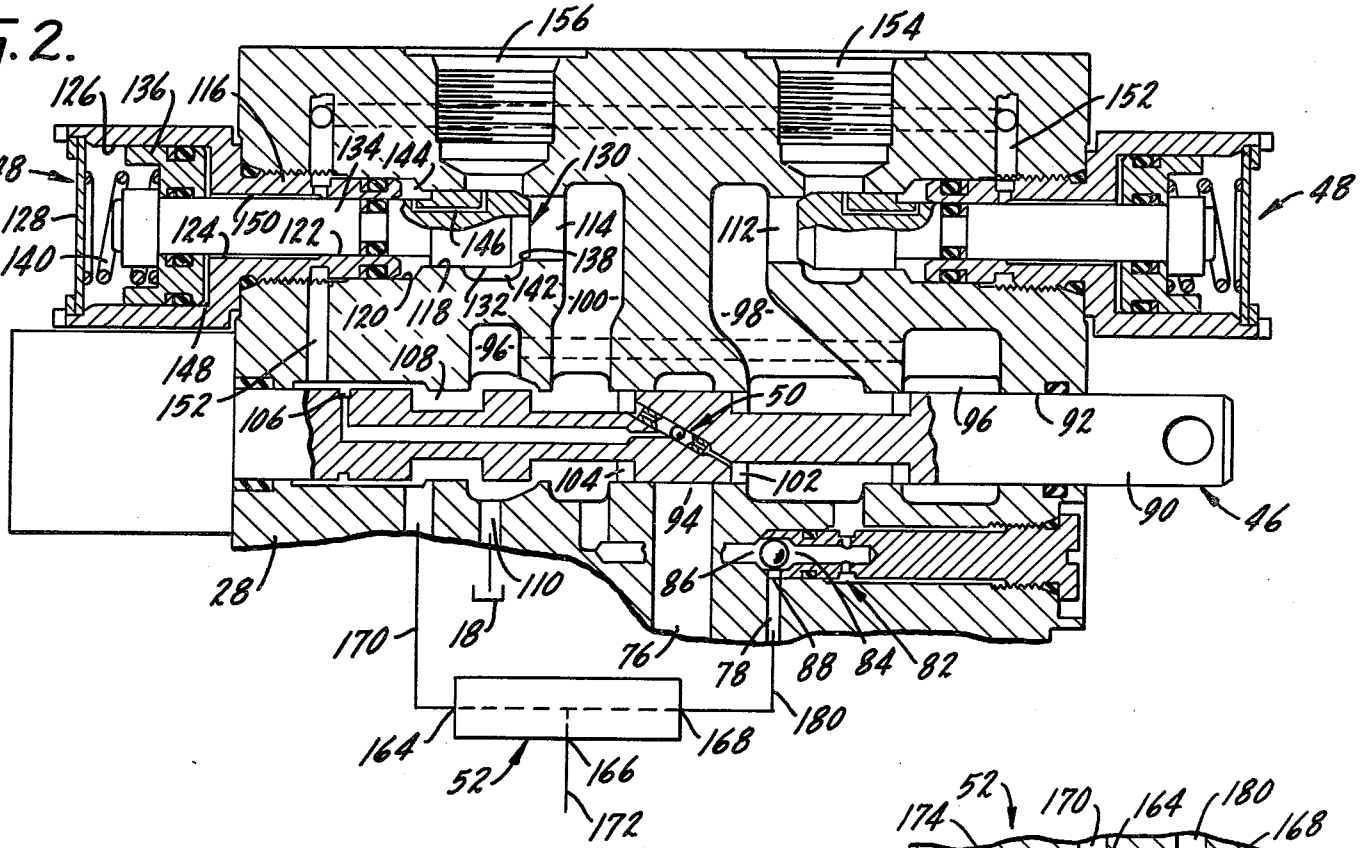
FIG. 2 is a sectional view showing details of the control section, including a manual control valve and its associated pair of pilot-operated motor port lock-out valves, and the logic circuit of this invention.
Figure 3:
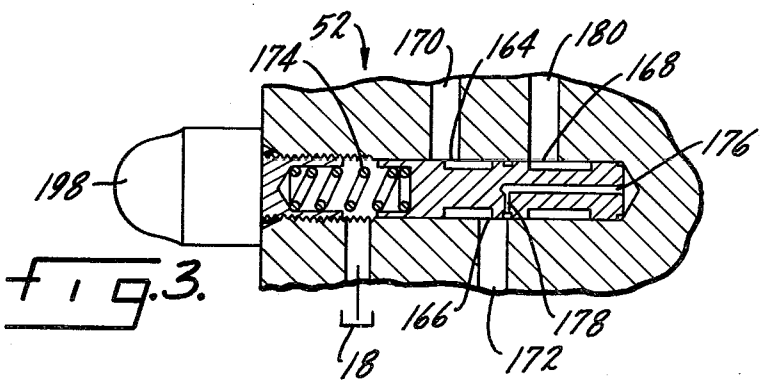
FIG. 3 is a sectional view showing details of the pressure regulating valve.

Referring now to the drawings in greater detail, and in particular to FIGS. 1, 2 and 3, there is shown an open center fluid control system including a fluid supply section 10, an inlet section 12, a directional control valve assembly 14 and a fluid motor 16.

Fluid supply section 10 is similar in construction and operation to the fluid supply section disclosed in the aforementioned U.S. Pat. No. 3,693,506. Fluid supply section 10 includes a reservoir or tank 18 and a pump 20. In the preferred form of the invention as shown herein, pump 20 is a fixed displacement pump. The output of pump 20 is connected to a fluid line 22.

Inlet section 12 is similar in construction and operation to the inlet section disclosed in the aforementioned U.S. Pat. No. 3,693,506. Inlet section 12 includes a bypass valve 24 and a relief valve 26. Bypass valve 24 includes, in a housing 28, a bore 30 and a bypass valve seat 32. A bypass valve element 34 is slidable in bore 30 and is biased by a bypass valve spring 36 toward engagement with valve seat 32. At the head end of valve element 34 a bypass inlet chamber 38 is in fluid communication with fluid line 22. At the spring end of bypass element 34 a bypass spring chamber 40 is in fluid communication with relief valve 26, which in turn communicates with tank 18. Between chambers 38 and 40 a bypass outlet chamber 42 also is in communication with tank 18. When spring chamber 40 is in fluid communication with tank 18, the force of spring 36 will determine supply pressure. For example, if spring 36 is selected to have a force equivalent to 100 psi, it will tend to bias valve element 34 toward valve seat 32, thereby tending to restrict fluid communication between chambers 38 and 42. Supply bypass pressure, the output from pump 20, will be 100 psi. When fluid communication from chamber 40 to tank 18 is closed off and fluid pressure is directed into spring chamber 40, the output from pump 20 will increase. For example, if 100 psi is introduced into chamber 40, this pressure, in addition to the force of spring 36, will tend to bias element 34 closer to seat 32, thereby further restricting fluid communication from chamber 38 to chamber 42. As a result, supply pressure would be increased to 200 psi. Relief valve 26 determines the maximum level of fluid pressure allowable in spring chamber 40, above which relief valve 26 opens and vents chamber 40 to tank 18.

If it is desired to incorporate a flow extending bypass valve in the system, the bypass valve disclosed in the aforementioned U.S. Pat. No. 3,631,890 may be substituted for inlet section 12 herein.

Directional control valve assembly 14 has a single control valve section, and includes a flow control valve 44, a manual control valve 46, a pair of pilot-operated motor port lock-out valves 48 and a logic circuit incorporating as a portion thereof a first shuttle valve 50 and a regulating valve 52 in the form of an infinite positioning three-way valve.

Flow control valve 44 includes a bore 54 defined by housing 28, a flow control inlet chamber 56 in fluid communication with fluid line 22, a flow control outlet chamber 58 and a flow control pressure chamber 60. A flow control piston 62 is slidable in bore 54 and is generally a hollow cylinder having a barrier portion 64 which separates a bore portion 66 from pressure chamber 60. Piston 62 defines a plurality of ports 68 communicating inlet chamber 56 with bore portion 66. Similarly, piston 62 defines a plurality of ports 70 communicating bore portion 66 with outlet chamber 58. A suitable spring 72 is provided in pressure chamber 60 for biasing piston 62. As thus described, flow control valve 44 is similar in construction and operation to the improved flow control valve disclosed in the aforementioned U.S. Pat. No. 3,592,216. As disclosed in detail therein, flow control valve 44 limits the pressure supplied to manual control valve 46 and maintains the required fluid flow thereto.

In addition, flow control valve 44 further includes a plurality of ports 74 defined by piston 62 communicating inlet chamber 56 with bore portion 66 when piston 62 is moved rightwardly to its extreme position against the force of spring 72. Ports 74 are provided for a purpose to be disclosed herein.

A fluid line 76 is in communication with chamber 58 and a fluid line 78 is in communication through an orifice 80 with chamber 60. A primary shuttle valve 82 includes side shuttle connections 84 and 86 and a center shuttle connection 88. Primary shuttle valve 82 corresponds to shuttle valve 31 in the aforementioned U.S. Pat. No. 3,693,506.

In the preferred form of the invention illustrated herein, manual control valve 46 is in the form of a valve spool 90 slidable in a bore 92 defined by housing 28. Housing 28 defines an inlet port 94, an outlet port 96, and motor ports 98 and 100 communicating with bore 92. Valve spool 90 also defines fluid connections 102, 104, 106 and 108.

Inlet port 94 is in communication with line 76. Outlet port 96 is in communication through a line 110 with tank 18. Motor ports 98 and 100 respectively are in communication with fluid lines 112 and 114. Fluid connections 102 and 104 respectively are in communication with shuttle connections 84 and 86 of shuttle valve 82. Shuttle connection 88 of shuttle valve 82 is in communication with line 78.

Manual control valve 46 has four operating positions. Valve spool 90 is slidable from the neutral position shown to a right power position, to a near left power position, and to a far left float position.

Each motor port lock-out valve 48 includes an insert member 116 secured to housing 28. In effect, insert member 116 becomes a portion of housing 28. A lock-out bore includes bore portions 118 and 120 defined by housing 28. Insert member 116 defines bore portion 122, bore portion 124 of slightly increased diameter and bore portion 126 of significantly larger diameter. A suitable cover 128 closes the outer end of insert member 116. A slidable lock-out valve element 130 includes an inner portion 132 slidable within bore portion 118, an intermediate portion 134 slidable within bore portion 122 and an exterior piston portion 136 slidable within bore portion 126. Portion 132 of element 130 is engageable with a lock-out valve seat 138 defined by housing 28. A suitable spring 140 biases valve element 130 toward valve seat 138.

Housing 28 defines a lock-out chamber 142 between bore portion 118 and valve seat 138. A lock-out pressure chamber 144 is defined by bore portions 118 and 120, member 116 and valve element 130. A fluid passage 146 defined by element 130 communicates chambers 142 and 144. The arrangement is such that pressure in chamber 142 will be communicated to chamber 144 so as to bias valve element 130 toward valve seat 138.

Piston portion 136 and member 116 define therebetween a piston pressure chamber 148. Portion 134 of valve element 130 and bore portion 124 together form a fluid passage 150 in communication with pressure chamber 148. Housing 28 defines a pilot fluid line 152 communicating with passage 150 and also in communication with fluid connections 106 and 108 of manual control valve 46.

A pair of fluid lines 154 and 156 communicate chambers 142 with fluid motor 16. In the preferred form of the invention illustrated herein, fluid motor 16 is a cylinder with its rod end in communication with line 154 and its head end in communication with line 156. When motor port lock-out valves 48 are open, fluid line 154 is in communication through its associated lock-out valve chamber 142 with fluid line 112. Similarly, fluid line 156 is in fluid communication through its associated lock-out valve chamber 142 with fluid line 114.

The improved logic circuit for the arrangement shown schematically in FIG. 1 includes shuttle valve 50 associated with manual control valve 46, and pressure regulating valve 52 associated with bypass valve 24. Shuttle valve 50 includes side shuttle connections 158 and 160 and a center shuttle connection 162. With manual control valve 46 in the neutral position, motor ports 98 and 100, fluid connections 102, 104 and 108, and shuttle connections 158 and 160 are all in communication with outlet port 96. Fluid connection 106 communicates with shuttle connection 162 and through fluid connection 108 with shuttle connections 158 and 160.

Pressure regulating valve 52, an infinite positioning three-way valve, includes fluid ports 164, 166 and 168. Port 164 communicates through a fluid line 170 with fluid connections 106 and 108 as well as with pilot line 152. Port 166 communicates through a fluid line 172 with spring chamber 40 of bypass valve 24. Port 168 communicates through a fluid line 180 with fluid line 78 between orifice 80 and shuttle connection 88 of shuttle valve 82. A suitable spring 174 is provided to bias pressure regulating valve 52 toward the right position shown schematically in FIG. 1. In a preferred form of the invention, spring 174 is adjustable so that this biasing force may be varied. Fluid line 172 communicates through a regulating pilot line 176 having an orifice 178 therein with the opposite end of pressure regulating valve 52, such that fluid pressure will tend to bias pressure regulating valve 52 in opposition to the biasing force of spring 174.

Manual control valve 46 is a four position valve including a neutral position, two power positions immediately adjacent the neutral position on either side thereof, and a float position beyond one of the power positions. With manual control valve 46 in the neutral position as shown schematically in FIG. 1, the valve side of each lock-out valve 48 is vented to tank 18, lines 112 and 114 respectively communicating through motor ports 98 and 100 with outlet port 96 and line 110. In the power positions, inlet port 94 communicates with one or the other of motor ports 98 and 100, the other motor port communicating with tank 18 through outlet port 96 and line 110. In the float position, regulated supply pressure is connected from inlet port 94 through shuttle valve 50 and fluid connection 106 to pilot line 152. At the same time, motor ports 98 and 100 are connected through outlet port 96 to each other and to line 110 and tank 18.

With manual control valve 46 in the neutral position, spring chamber 40 of bypass valve 24 is vented to tank 18 through line 172, ports 166 and 164, line 170, connection 108, port 96, and line 110. Supply pressure acts on bypass valve element 34 in opposition to the biasing force of spring 36, and fluid is bypassed from chamber 38 to chamber 42 and tank 18 at a relatively low bypass pressure. Assuming, for example, that the biasing force of spring 36 is equivalent to 100 psi, bypass pressure, and thus the supply bypass pressure in line 22, will be limited to 100 psi. Connections 158, 160 and 162 are vented to tank 18 through port 96 and line 110. Thus, neutral position system operation is the same as described in the aforementioned U.S. Pat. No. 3,693,506.

With manual control valve 46 shifted to one of the power positions, for example to the power position between neutral and float, supply pressure is communicated with the valve side of one lock-out valve 48 through line 22, flow control valve 44, line 76, ports 94 and 100, and line 114. The valve side of the other lock-out valve 48 is communicated with tank 18 through line 112, ports 98 and port 96, and line 110. Supply pressure is sensed in spring chamber 40 and pilot line 176 through port 94, connections 160 and 162 of shuttle valve 50, connection 106, line 170, ports 164 and 166 of pressure regulating valve 52, and line 172. This pressure also is sensed in lock-out pilot line 152 through connection 106. This pressure supplements the biasing force of spring 36 and causes valve element 34 to move closer to valve seat 32, thereby further restricting communication from chamber 38 to chamber 42. As a result, supply pressure increases throughout the logic circuit described.

Pressure regulating valve 52 shifts to the left position shown schematically in FIG. 1 when the pressure in pilot line 176 exceeds the biasing force established by spring 174. In this position, supply pressure is sensed in spring chamber 40 through ports 94 and 104, shuttle valve 82, lines 78 and 180, ports 168 and 166 and line 172. Supply pressure increases to the level necessary to open lock-out valves 48 and actuate fluid motor 16. Thus, in the power position, load-actuating pressure is sensed in spring chamber 40 through shuttle valve 82, and bypass valve 24 operates in the manner of the aforementioned U.S. Pat. No. 3,693,506. With manual control valve 46 shifted to the other power position, a similar operating condition is obtained.

When manual control valve 46 is shifted to the float position, it is desirable that both lock-out valves 48 be opened and held in the open position without bypass valve 24 developing an excessive bypass pressure. Assuming for example, that lock-out valves 48 are arranged such that a lock-out pressure of 200 psi in pressure chamber 148 is sufficient to overcome the biasing force of spring 140 and the biasing pressure in chamber 144, lock-out valves 48 open when the lock-out pressure in pilot line 152 reaches 200 psi. Thus, if lock-out valves 48 are such that they open at 200 psi, it is necessary for bypass valve 24 to develop only 200 psi when manual control valve 46 is in the float position.

In the float position, pressure chamber 60 of flow control valve 44 is vented to tank 18 through orifice 80, line 78, shuttle valve 82, connections 102 and 104, port 96, and line 110. Supply pressure from pump 20 is directed through line 22, chamber 56, and orifices 68 into chamber 66. Position 62 is moved to the extreme right position, as shown in FIG. 1, against the force of spring 72. In this position, chamber 56 is communicated through orifices 74 with chamber 66. Chamber 66 is communicated through orifices 68 and 70, chamber 58, and line 76 with port 94. Supply pressure is sensed at lock-out valves 48 through shuttle valve 50, connection 106, and pilot line 152. This pressure also is sensed at spring chamber 40 of bypass valve 24 through line 170, ports 164 and 166, and line 172. Pressure in spring chamber 40 biases valve element 34 toward valve seat 32, thereby further restricting bypass flow and causing supply pressure to increase.

Pressure throughout the system increases, and as the pressure in line 172 increases to the setting of spring 174, for example 100 psi, pressure regulating valve 52 will seek a position so as to maintain 100 psi in line 172 by metering either from port 164 to port 166 or from port 166 to port 168. Port 168 is connected to tank 18 through lines 180 and 78, shuttle valve 82, connections 102 and 104, port 96, and line 110. The pressure in line 172 is maintained at 100 psi. If the force of spring 36 is equivalent to 100 psi, supply pressure will be 200 psi, and pressure throughout the entire logic circuit will be 200 psi. Lock-out valves 48 will open, and will be held in the open position so long as manual control valve 46 is in the float position.

Thus, it will be seen that a fluid control system is provided, which system incorporates a manual control valve having a neutral position, two power positions, and a float position. A pair of motor port lock-out valves are associated with the manual control valve. They are pilot-operated, and are arranged so as to remain closed when the manual control valve is in neutral, to open and remain open when the manual control valve is in either power position, and to open and remain open when the manual control valve is in float. Supply pressure is maintained at a low bypass level with the manual control valve in the neutral position. In the power positions supply pressure is the load-actuating pressure required to operate an associated fluid motor.

In the float position, supply pressure need be a lock-out pressure only slightly higher than bypass pressure in order to open and hold open the lock-out valves.

There may be circumstances in which it is desirable to incorporate a plurality of valve sections in directional control valve assembly 14. This is shown schematically in FIG. 4, where one or more additional valve sections are represented by flow control valve 44*a*, manual control valve 46*a*, motor port lock-out valves 48*a*, and associated circuitry. It should be understood that these valves are identical, respectively, to valves 44, 46 and 48. A suitable fluid motor 16*a* may be identical or similar to fluid motor 16.

A secondary shuttle valve 182, corresponding to shuttle valve 130 in the aforementioned U.S. Pat. No. 3,693,506, has side shuttle connections 184 and 186 and a center shuttle connection 188. Shuttle valve 182 is inserted in line 180 with shuttle connection 184 connected to line 78 and shuttle connection 188 connected to port 168 of pressure regulating valve 52. Similarly, shuttle connection 186 is connected through a line 180*a* to line 78*a* of the other control section. Line 180*a* is identical to line 180.

The improved logic circuit now includes a second shuttle valve 190 having side shuttle connections 192 and 194 and a center shuttie connection 196. Shuttle valve 190 is inserted in line 170 with shuttle connection 192 connected to connections 106 and 108, and to pilot line 152. Shuttle connection 196 is connected to port 164 of pressure regulating valve 52. Shuttle connection 194 is connected through a line 170*a* to connections 106*a* and 108*a*, and to pilot line 152*a* of the other control section. Line 170*a* is identical to line 170. Thus, it will be seen that in a directional flow control assembly having, for example, two flow control sections, the improved logic circuit includes first shuttle valve 50 and 50*a* associated respectively with manual control valves 46 and 46*a*, a second shuttle valve 190, and a pressure regulating valve 52 associated with bypass valve 24 of inlet section 12. In the neutral and power positions, the system operates in the manner described above. However, there may be circumstances in which it is desirable to have one manual control valve in float and, at the same time, to move the other manual control valve from neutral to one of its power positions. Assume, for example, that manual control valve 46 is in float and that manual control valve 46*a* is in neutral. In order to operate manual control valve 46 in in float, supply pressure must be increased to a load-actuating pressure required at motor ports 98*a* and 100*a*.

Figure 4:
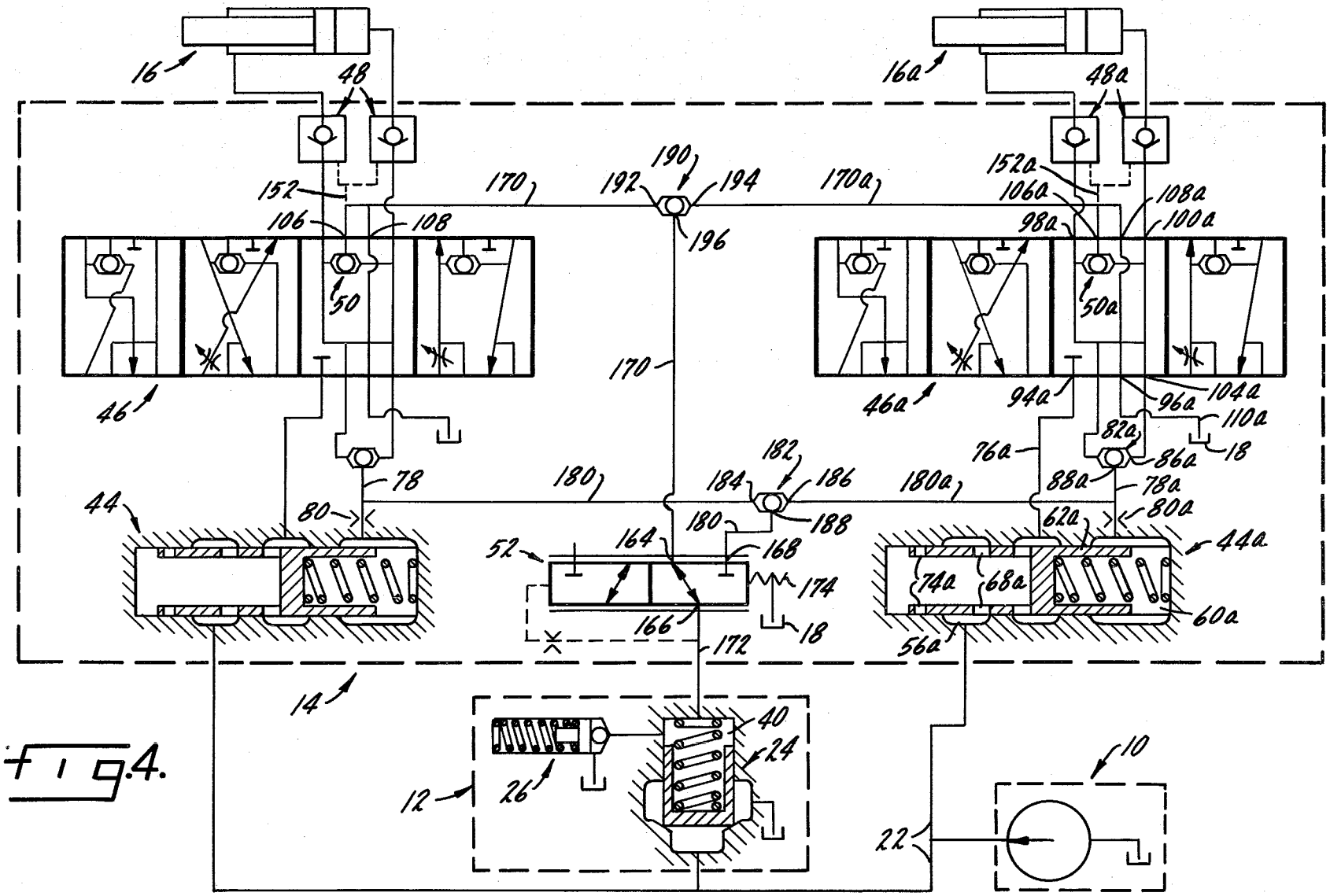
FIG. 4 is a schematic diagram similar to FIG. 1 showing the directional control valve assembly having a plurality of control sections.

This is accomplished by sensing a motor port pressure of manual control valve 46*a* at spring chamber 40 of bypass valve 24. Assume, for example, that manual control valve 46*a* is moved to the power position between its neutral and float positions. Supply pressure is sensed through line 22, flow control valve 44*a* line 76*a*, ports 94*a* and 104*a*, shuttle connections 86*a* and 88*a* of shuttle valve 82*a*, lines 78*a* and orifice 80*a*. With supply pressure being sensed in pressure chamber 60*a*, piston 62*a* of flow control valve 44*a* moves leftwardly, as shown in FIG. 4, closing orifices 74*a* and opening orifices 68*a* to inlet chamber 56*a*.

Supply pressure also is sensed at port 168 of pressure regulating valve 52 through line 180*a*, shuttle connections 186 and 188 of shuttle valve 182, and line 180. Thus, 200 psi is sensed at both ports 164 and 168. The pressure sensed at port 166 and in line 172 must become 200 psi. Pressure regulating valve 52 shifts against the biasing force of spring 174 to communicate ports 166 and 168. As a result, the pressure at motor port 100*a* of manual control valve 46*a* is sensed in spring chamber 40 of bypass valve 24. Supply pressure increases sufficiently to open lock-out valves 48*a* and deliver flow to fluid motor 16*a*. Return flow from motor 16*a* is directed through port 98*a*, port 96*a*, and line 110*a* to tank 18.

The increased supply pressure also is sensed at lock-out valves 48, thereby holding them open while manual control valve 46 is in float.

Thus, it should be apparent that operation of either control valve section in either power position will result in actuation of the logic circuit through opposite ports of the various shuttle valves. The result is regulated automatic lock-out valve actuation for both power and float positions of any control valve section irrespective of the position of any other control valve section.

The description so far has been with regard to operation of the system in an open center circuit. When operating in a closed center circuit, a minimum supply pressure of 200 psi is available with the manual control valves in the neutral or float positions. This supply pressure is sufficient to open the lock-out valves when either manual control valve is moved to its float position. Neither shuttle valve 190 nor pressure regulating valve 52 is required to develop this 200 psi. Therefore, by removing spring 174 from pressure regulating valve 52, or alternatively by adjusting the biasing force of spring 174 to zero, through and adjusting cap 198 for example, pressure regulating valve 52 is held in a position communicating ports 166 and 168. This prevents any pressure increase in line 172 and spring chamber 40 of bypass valve 24, thereby preventing any increase in supply pressure. 200 psi is sensed at lock-out valve 48 or 48*a*. Thus, a simple modification of the system, namely removal of the biasing force of spring 174 of pressure regulating valve 52, is all that is required to connect the system for operation is a closed circuit configuration.

Figure 5:
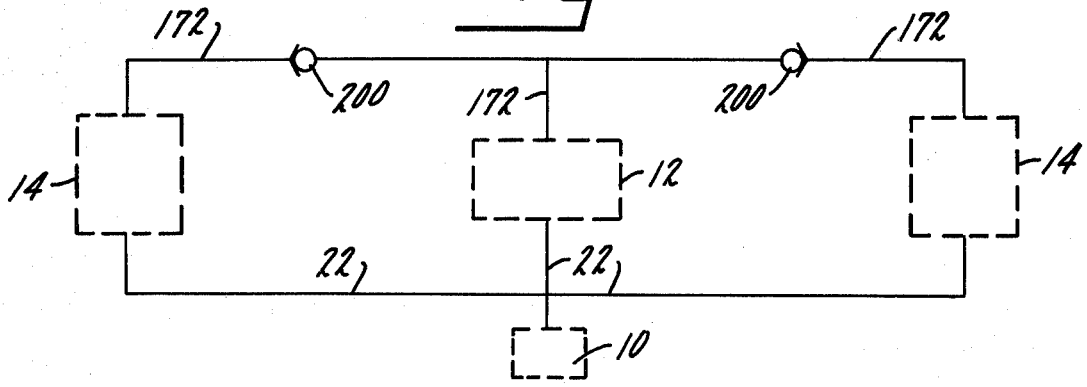
FIG. 5 is a schematic diagram showing the arrangement for connecting a plurality of directional control valve assemblies in the system.

There may be circumstances in which it is desirable to establish a system incorporating more than one directional control valve assembly 14, with each assembly having one or more control valve sections. This arrangement is shown schematically in FIG. 5. Each assembly 14 includes a line 172 communicating its associated pressure regulating valve 52 with spring chamber 40 of bypass valve 24. A check valve 200 in each line 172, or a shuttle valve between lines 172, insures that the highest pressure in any line 172 will be the pressure sensed in spring chamber 40. Thus, as many directional control valve assemblies as desired may be connected together in the system as disclosed herein.

While a preferred embodiment of the invention has been shown and described, this should be considered as illustative only and may be modified by those skilled in the art. It is intended that the claims herein cover all such modifications as may fall within the spirit and scope of the invention.

What is claimed is:

1. A fluid system comprising a reservoir, a pump having a pump inlet communicating with said reservoir, and a pump outlet, a bypass valve establishing communication between said pump outlet and said reservoir in an open position thereof so as to determine pump pressure, a fluid motor, and a fluid control assembly including a control valve, said control valve having an inlet port communicating with said pump outlet, an outlet port communicating with said reservoir, and first and second motor ports, said fluid control assembly further including first and second pilot-operated lock-out valves respectively establishing communication between said first and second motor ports and said fluid motor in an open position thereof and blocking communication therebetween in a closed position thereof, and logic means for effecting pilot operation of said lock-out valves, said control valve having a neutral position in which said logic means causes said bypass valve to determine a bypass pressure insufficient for pilot operation of said lock-out valves to their open position, a float position in which said logic means causes said bypass valve to determine a lock-out pressure higher than said bypass pressure and sufficient for pilot operation of said lock-out valves to their open position, and first and second power positions in which said logic means causes said bypass valve to determine said lock-out pressure for pilot operation of said lock-out valves to their open position thereby permitting fluid flow to said fluid motor at a load-actuating sufficient to actuate said fluid motor.

2. The invention of claim 1, said bypass valve including a movable bypass valve element, and a bypass valve seat, said bypass valve blocking said communication between said pump outlet and said reservoir when said valve element is seated on said valve seat and establishing said communication therebetween when said valve element is not seated on said valve seat, said bypass valve further including a bypass spring chamber, and a bypass spring in said spring chamber biasing said valve element toward said valve seat, said logic means communicating said spring chamber with said reservoir when said control valve is in said neutral position such that said bypass valve establishes said bypass pressure at a level determined by the force of said bypass spring, said logic means communicating said pump outlet with said spring chamber when said control valve is in said float and power positions such that said bypass valve establishes said lock-out pressure at a level determined by the pressure in said spring chamber and the force of said bypass spring.

3. The invention of claim 2, said logic means communicating said spring chamber with said reservoir through said control valve when said control valve is in said neutral position, said logic means communicating said pump outlet with said spring chamber through said control valve when said control valve is in said float and power positions.

4. The invention of claim 3, said logic means including means for establishing a maximum limit for the pressure in said spring chamber when said control valve is in said float position thereby establishing a maximum limit for the lock-out pressure determined by said bypass valve.

5. In a fluid system including a reservoir, a pump having a pump inlet communicating with said reservoir, and a pump outlet, a fluid motor, and a flow control valve having an inlet port communicating with said pump outlet, an outlet port communicating with said reservoir, and first and second motor ports, said control valve being movable to a neutral position communicating said motor ports with said outlet port, to first and second power positions respectively communicating said inlet port selectively with one of said motor ports and the other of said motor ports with said outlet port, and to a float position communicating said motor ports with said outlet port; the improvement comprising first and second pilot-operated motor port lock-out valves respectively communicating said first and second motor ports with said fluid motor in an open position thereof, and means for effecting pilot operation of said lock-out valves to their open position upon movement of said control valve to its power and float positions.

6. The invention of claim 5, further comprising a bypass valve having a bypass valve element movable toward and away from a bypass valve seat to thereby determine pump pressure, a bypass spring chamber, and a bypass spring in said chamber biasing said valve element toward said valve seat so as to determine a bypass pressure insufficient for pilot operation of said lock-out valves to their open position; the improvement wherein said effecting means communicates said spring chamber with said reservoir when said control valve is in its neutral position, communicates said one motor port with said spring chamber when said control valve is in its respective power positions, and communicates said pump outlet with said spring chamber when said control valve is in its float position, whereby pressure in said spring chamber and the force of said bypass spring cause said bypass valve to determine a lock-out pressure sufficient for pilot operation of said lock-out valves to their open position when said control valve is in its power and float positions.

7. The invention of claim 6, said effecting means including pressure regulating means for establishing the maximum pressure in said spring chamber when said control valve is in its float position thereby determining the maximum value of said lock-out pressure.

8. The invention of claim 7, said pressure regulating means being a pressure regulating valve having biasing means for establishing said maximum pressure.

9. The invention of claim 8, said biasing means being adjustable so as to adjust said maximum pressure.

10. The invention of claim 9, said biasing means being adjustable to provide a biasing force of zero thereby rendering said pressure regulating means ineffective.

11. The invention of claim 8, said biasing means being removable thereby rendering said pressure regulating means ineffective.

12. The invention of claim 6, said effecting means including a fluid-actuated shuttle valve movable with said control valve, said shuttle valve having first and second side connections and a center connection, said center connection communicating with said spring chamber, said first and second side connections respectively communicating with said first and second motor ports when said control valve is in said neutral and power positions, said first and second side connections respectively communicating with said inlet port and said outlet port when said control valve is in said float position.

13. The invention of claim 12, said effecting means including a pressure regulating valve between said center connection and said spring chamber, said pressure regulating valve communicating said spring chamber with said center connection when said control valve is in said neutral position, said pressure regulating valve regulating the pressure in said spring chamber to a predetermined value when said control valve is in said float position.

14. The invention of claim 13, said pressure regulating valve being an infinite positioning three-way valve having resilient biasing means for establishing said predetermined value, and means directing pressure from said spring chamber to bias said three-way valve in opposition to said resilient biasing means, whereby said three-way valve regulates pressure in said spring chamber to said predetermined value when said control valve is in said float position.

15. In a fluid system including a reservoir, a pump having a pump inlet connected to said reservoir, and a pump outlet, a fluid motor, a directional control valve having an inlet port, an outlet port connected to said reservoir, a pair of motor ports, a pair of control ports, and a directional control valve member, said member being movable to neutral and float positions connecting said motor ports and said control ports to said outlet port, said member also being movable to first and second power positions respectively connecting said inlet port selectively to one of said motor ports and the other of said motor ports to said outlet port, said member selectively connecting one of said control ports to said one motor port and the other of said control ports to said outlet port when said inlet port is connected to said one motor port, flow control means connected to said pump outlet and said inlet port for controlling fluid supplied to said directional control valve when said member is in said power positions, and fluid-actuated valve means including a pair of signal ports respectively connected to said control ports and another signal port connected to said flow control means, said fluid-actuated valve means being effective for connecting said one control port to said flow control means such that fluid supplied to said directional control valve is a function of fluid pressure in said one motor port; the improvement comprising a pair of pilot-operated motor port lock-out valves respectively connecting said motor ports to said fluid motor in an open position and blocking connection thereto in a closed position, said lock-out valves being biased toward their closed position, and means for effecting pilot operation of said lock-out valves to their open position when said valve member is in one of said float and power positions, said flow control means connecting said pump outlet to said inlet port when said member is in said float position.

16. A fluid system including a reservoir; a pump having a pump inlet communicating with said reservoir, and a pump outlet; a bypass valve establishing communication between said pump outlet and said reservoir in an open position thereof so as to determine pump pressure; a plurality of fluid motors; and a fluid control assembly including a plurality of control sections, each section having a directional control valve, said directional control valve having an inlet port communicating with said pump outlet, an outlet port communicating with said reservoir, and a pair of motor ports, a pair of motor port lock-out valves respectively establishing communication between said motor ports and an associated fluid motor in an open position thereof and blocking communication therebetween in a closed position thereof, said lock-out valves being biased toward their closed position, and logic means for effecting pilot operation of said lock-out valves, said control valve having a neutral position in which said logic means causes said bypass valve to generate a bypass pressure insufficient for pilot operation of said lock-out valves to their open position, a float position in which said logic means causes said bypass valve to generate a lock-out pressure higher than said bypass pressure and sufficient for pilot operation of said lock-out valves to their open position, and first and second power positions in which said logic means causes said bypass valve to generate said lock-out pressure for pilot operation of said lock-out valves to their open position thereby permitting fluid flow to said associated fluid motor at a load-acutating pressure sufficient to actuate said associated fluid motor; said flow control assembly further including means associated with all of said logic means for causing said bypass valve to generate said lock-out pressure when any of said control valves is in said float and power positions.

17. In a fluid system including a source of fluid supply having a reservoir and a pump, a plurality of fluid motors, a plurality of directional control valves each connected by conduit means to an associated fluid motor, flow control means connected to said pump and said directional control valves for controlling the fluid supplied by said pump to said directional control valves, each of said directional control valves having a control port sensing the pressure being supplied to its associated fluid motor, and means interconnecting said control ports and said flow control means for selecting the highest pressure being supplied to any of said fluid motors for use as a signal pressure and for directing said signal pressure to said flow control means, said flow control means being responsive to said signal pressure for controlling the fluid suppled by said pump to said directional control valves; the improvement wherein each directional control valve has a float position respectively connecting its associated conduit means to said reservoir, pilot-operated lock-out valve means in each of said conduit means, each of said lock-out valve means having an open position establishing said connection from its associated directional control valve to its associated fluid motor and a closed position blocking said connection, and means for effecting pilot operation of said lock-out valve means to their open position in response to movement of their associated directional control valve to said float position.

18. A fluid system comprising a reservoir, a pump having a pump inlet communicating with said reservoir, and a pump outlet, a bypass valve having a bypass valve element movable toward and away from a bypass valve seat to thereby determine pump pressure, a bypass spring chamber, and a bypass spring in said chamber biasing said valve element toward said valve seat so as to generate a bypass pressure, a plurality of fluid motors, and at least one directional control assembly including a plurality of control valve sections, each section including a directional control valve having an inlet port, an outlet port communicating with said reservoir, a pair of motor ports, first and second pairs of control ports, and a directional control valve member, said member being movable to a neutral position communicating said motor ports and said first pair of control ports and one of said second pair of control ports with said outlet port, said member also being movable to first and second power positions selectively communicating said inlet port and one of said first pair of control ports with one of said motor ports and communicating the other of said motor ports and the other of said first pair of control ports with said outlet port, said member further being movable to a float position communicating said motor ports and said first pair of control ports with said outlet port, each section also including flow control means communicating with said pump outlet and said inlet port for controlling fluid supplied to said directional control valve, and primary shuttle valve means including a pair of primary signal ports respectively communicating with said first pair of control ports, and an additional primary signal port communicating with said flow control means, said assembly also including secondary shuttle valve means including a plurality of secondary signal ports respectively communicating with said additional primary signal ports, and an additional secondary signal port communicating with said spring chamber such that fluid supplied to said directional control valves is a function of the highest fluid pressure in any of said one motor ports when said member is in said power positions, each section further including a pair of motor port lock-out valves biased toward a closed position respectively blocking communication between said motor ports and an associated fluid motor, said lock-out valves being pilot-operated to an open position establishing communication between said motor ports and said associated fluid motor, each lock-out valve having pilot-operating means communicating with the other of said second pair of control ports, and first shuttle valve means movable with said member, said first shuttle valve means including a first shuttle port communicating with said other of said second pair of control ports, and a pair of additional first shuttle ports, said pair of additional first shuttle ports respectively communicating with said pair of motor ports when said member is in said neutral and power positions, and said pair of additional first shuttle ports respectively communicating with said inlet port and said outlet port when said member is in said float position, said assembly further including shuttle valve means including a plurality of second shuttle ports respectively communicating with said pair of second control ports, and an additional second shuttle port communicating with said spring chamber such that upon movement of one of said members to said float and power positions bypass pressure is sensed in said spring chamber, whereby said bypass valve element is pressure biased toward said bypass valve seat such that said bypass valve generates a lock-out pressure sufficiently higher than said bypass pressure to effect pilot operation to their open position of the pair of lock-out valves associated with said one member.

19. The invention of claim 18, further comprising pressure regulating means interposed between said additional secondary signal port and said additional second shuttle port and said spring chamber, said pressure regulating means regulating the pressure sensed in said spring chamber when said member is in said float position.

20. The invention of claim 19, said pressure regulating means being an infinite positioning three-way valve having resilient means biasing said three-way valve toward a first position communicating said spring chamber with said additional second shuttle port, and pilot means for utilizing pressure sensed in said spring chamber to bias said three-way valve toward a second position communicating said spring chamber with said additional secondary signal port.

21. The invention of claim 20, said resilient means being adjustable to predetermine the force biasing said three-way valve toward said first position.

22. The invention of claim 21, said resilient means being adjustable to predetermine a biasing force of zero, whereby said three-way valve remains in said second position.

23. The invention of claim 18, each of said lock-out valves comprising a housing defining a main passage adapted to communicate an associated motor port with an associated fluid motor, said housing defining a bore intersecting said main passage and a lock-out valve seat therein; said bore having a first bore portion of small diameter, a second bore portion of intermediate diameter, and a third bore portion of large diameter, a lock-out valve element having first and third element portions slidable in said first and third bore portions, and an intermediate element portion slidable in and cooperating with said intermediate bore portion to form a fluid passage communicating with said third bore portion, said first and intermediate element portions cooperating with said first and intermediate bore portions to form a fluid chamber, a lock-out spring biasing said element toward a closed position in which said first element portion is seated on said lock-out valve seat blocking said main passage, said first element portion defining a biasing passage communicating said main passage with said fluid chamber such that pressure in said fluid chamber also biases said element toward said lock-out valve seat when said first element portion is seated thereon, and pilot line means adapted to communicate said fluid passage with an associated other one of said second pair of control ports such that pressure in said third bore portion is sufficient to slide said element to an open position in which said first element portion is not seated on said lock-out valve seat and flow may be established in said main passage.

24. The invention of claim 18, comprising a plurality of control assemblies, each assembly communicating with said spring chamber through a check valve, whereby pressure sensed in said spring chamber is the highest pressure in any of said assemblies.

25. The invention of claim 8, comprising a plurality of control assemblies, each assembly communicating with said spring chamber through a shuttle valve, whereby pressure sensed in said spring chamber is the highest pressure in any of said assemblies.

* * * * *

UNITED STATES PATENT OFFICE

CERTIFICATE OF CORRECTION

PATENT NO. : 4,145,958

DATED : March 27, 1979

INVENTOR(S) : DAVID RICHARD ILLE

It is certified that error appears in the above-identified patent and that said Letters Patent are hereby corrected as shown below:

Column 9, line 19, after "load-actuating" insert -- pressure --.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*